United States Patent [19]

Garkusha et al.

[11] 4,391,564

[45] Jul. 5, 1983

[54] EXHAUST PIPE OF TURBINE

[76] Inventors: Anatoly V. Garkusha, ulitsa 23 Avgusta, 63, kv. 82; Vladimir E. Dobrynin, pereulok Zernovoi, 6/4, kv. 49, both of, Kharkov, U.S.S.R.

[21] Appl. No.: 198,108

[22] PCT Filed: Nov. 27, 1979

[86] PCT No.: PCT/SU79/00116

§ 371 Date: Jul. 27, 1980

§ 102(e) Date: Jul. 23, 1980

[87] PCT Pub. No.: WO80/01093

PCT Pub. Date: May 29, 1980

[30] Foreign Application Priority Data

Nov. 27, 1978 [SU] U.S.S.R. ..... 2689216

[51] Int. Cl.[3] ..... F01D 25/24; F01D 25/30

[52] U.S. Cl. ..... 415/126; 415/148; 415/210

[58] Field of Search ..... 60/39.5; 415/126, 148, 415/150, 157, 209, 210, 134, 135, 138

[56] References Cited

U.S. PATENT DOCUMENTS

| | | | |
|---|---|---|---|
| 2,591,399 | 4/1952 | Buckland et al. | 415/209 |
| 2,821,067 | 1/1958 | Hill | 415/209 |
| 2,828,939 | 4/1958 | Grey | 415/209 |
| 4,013,378 | 3/1977 | Herzog | 415/219 R |

*Primary Examiner*—Louis J. Casaregola

*Attorney, Agent, or Firm*—McAulay, Fields, Fisher, Goldstein & Nissen

[57] ABSTRACT

An exhaust pipe (A) of a turbine has a housing (1). The walls of the housing (1) define a flow duct (2) accommodating therein a baffle (5) whose housing baffle (5) has a side surface (6) which is the surface of a body of revolution about an axis coinciding with the axis (7) of the turbine. The surface (6) has an inlet portion (8) having to a radius shorter than the outer radius R of the blades (3) of the runner (4) of the turbine.

Mounted within the flow duct (2) are guides (10) supporting the baffle (5) which is adjustable along the guides (10) relative to the housing (1) of the exhaust pipe (A) axially and/or transversely of the axis (7) of the turbine.

19 Claims, 4 Drawing Figures

EXHAUST PIPE OF TURBINE

FIELD OF THE INVENTION

The present invention relates to turbine engineering, and more particularly to an exhaust pipe for a turbine.

An exhaust pipe constructed in accordance with the present invention can be successfully incorporated in steam and gas turbines operated to drive power generators, air blowers, ship propellers and the like, i.e. working with variable flow rates of the working fluid and varying angular speeds of the rotor.

In particular the present invention is in axial-flow turbines with non-axisymmetric exhaust of the working fluid.

BACKGROUND OF THE INVENTION

Already known known is an exhaust pipe for a turbine, disposed directly downstream of the blades of the runner of the last stage of the turbine.

The walls of the housing of the exhaust pipe define the flow duct shaped as an axial-radial diffuser. The flow duct has mounted therein two stationary deflectors or baffles arranged coaxially with each other.

The baffles are intended to direct the working fluid from the working blades of the last stage of the turbine toward the outlet section of the exhaust pipe. Each baffle has a side surface shaped as a surface of a body of revolution. The longitudinal axis of the baffles is aligned with the axis of the turbine.

The baffles are arranged so that their inlet portions have a radii shorter than the outer radius of the working blades of the last stage of the turbine, with the axial spacing of the inlet portions of the baffles from the outlet or downstream edges of the working blades of the last stage of the turbine being substantially in excess of the axial thermal expansion of the turbine (cf. "Steam Turbines," ENERGIA Publishers, Moscow, USSR, 1976, pp. 302–307).

The known exhaust pipe does not provide for stable performance of the last stage of the turbine when the latter's operating duty is considerably different from the nominal one, i.e. the duty for which the turbine is designed to yield the maximum in economy ratings.

With the flow rate by volume of the working fluid, (e.g. steam), and/or with the angular speed of the rotor varying, the flow coming through the inlet of the pipe is a swirling one. The more the circumferential and radial components of the velocity of the working fluid therein are increased, the more the operating duty of the turbine differs from the nominal one. The centrifugal forces in the swirling flow form the surface of the stream of the working fluid into a hyperboloid of revolution; the same phenomenon is enhanced by a diffuser effect due to the curving shape of the inlet portions of the diffusers. Consequently, the flow of the working fluid breaks off the internal wall of the exhaust pipe, with the outer passages defined by the baffles and the external wall of the pipe housing passing the major share of the flow rate by volume of the working fluid, whereas circulation zones are formed adjacent to the internal wall of the housing, i.e. zones where the working fluid flows along closed surfaces.

Because of the axial asymmetry of the exhaust pipe, the circulation zones are disposed likewise asymmetrically relative to the axis of the turbine; in some areas they extend into the runner of the last stage. Under these conditions, each blade of the runner successively passes through areas with varying duties of the working fluid flow during each revolution of the rotor, which results in varying bending efforts, and, hence, in varying strain of the runner blades, whereby more often than not premature wear of the blades occurs. Furthermore, additional energy losses develop in the runner because of radial overflows and of the unstable character of the working fluid flow.

Additionally, the circulation zones in the exhaust pipes of steam turbines cause moisture particles, i.e. water droplets to find their way from the outlet portion of the pipe toward the runner blades. The resulting erosion wear of the downstream edges of the runner blades reduces the cross-sectional areas of the blades and distorts the shape of these cross-sectional areas, whereby the reliability and economy of the turbine are further impaired.

SUMMARY OF THE INVENTION

The present invention has for its main object to provide an exhaust pipe for a turbine, which should be of a structure providing for asymmetric flow of the working fluid through the last stage, and eliminating circulation zones in the vicinity of the last stage under various operating conditions of the turbine.

This object is attained by an exhaust pipe of a turbine having a housing with walls defining a flow duct accommodating therein a baffle housing a side surface which is essentially the surface of a body of revolution and has its longitudinal axis coinciding with the axis of the turbine, and with an inlet portion of a radius short of the outer radius of the blades of the runner of the last stage of the turbine, in which exhaust pipe, in accordance with the invention, the flow duct accommodates therein guides supporting thereon a baffle adapted to be adjusted therealong relative to the housing of the exhaust pipe, axially and/or transversely relative to the axis of the turbine.

This construction ensures the asymmetric flow of the working fluid and for eliminating circulation zones within the flow duct of the exhaust pipe and within the last stage of the turbine under various operating conditions.

It is preferred that the guides should extend parallel to the axis of the turbine and include screws operatively connected with a drive, with the baffle having openings made therein for the passage of said screws, the openings receiving therethrough nuts secured to the baffle and defining kinematic couples with the respective screws.

This concentration makes it possible to alter selectively the shape of the passage defined by the baffle and the walls of the exhaust pipe, so as to eliminate circulation zones therein.

It is preferred that the guides should extend transversely of the axis of the turbine and include screws operatively connected with a drive, with the baffle having openings made therethrough for the passage of the screws, the openings receiving therein nuts secured to the baffle and defining kinematic couples with the respective screws.

This construction provides for adjusting the axial symmetry of the flow of the working fluid downstream of the runner blades, which enhances the reliability and economy of their performance.

It is further preferred that the guides for adjusting the baffle be arranged so that some of them be parallel with the axis of the turbine and the others extend transversely thereto, with the guides including screws operatively connected each with a respective drive, the baffle having openings made therethrough for the passage of the screws, the openings receiving therein nuts secured to the baffle and defining kinematic couples with the respective screws, the walls of the housing of the exhaust pipe having therein slots for the displacement therein of said screws, respectively, axially of the turbine and transversely of the axis of the turbine.

This construction makes it possible to alter the shape and the flow passage area of the passages defined by the walls of the exhaust pipe and the baffle, so as to eliminate axial asymmetry of the flow, and, hence, to enhance the reliability and economy of the turbine under loads short of the nominal load.

It is further expedient that the inlet portion of the baffle be essentially cylindrical. This reduces energy losses when a swirling flow of the working fluid moves past the baffle.

It is further advisable that the edge of the inlet portion of the deflector be spaced axially from the outlet edges of the blades of the runner of the last stage of the turbine by an amount of which the minimum is somewhat in excess of the axial thermal expansion of the turbine.

This construction of the baffle is simple in manufacture and provides for expanding the range of the operating duties without the flow of the working fluid breaking off the internal wall of the exhaust pipe.

The disclosed structures of the exhaust pipe of a turbine make it possible, and that without affecting the economy ratings of the exhaust pipe at the nominal duty, to vary the shape and cross-sectional areas of individual passages in the axial-radial diffuser of the exhaust pipe as the operating duty varies from the nominal one, and thus to eliminate axial asymmetry of the flow in the last stage of the turbine and circulation zones in the diffuser of the exhaust pipe, which could otherwise have impaired the reliability and economic ratings of the turbine.

The axial symmetry of the flow of the working fluid eliminates additional alternating strain of the blades of the runner and additional energy losses therein, while the elimination of the circulation zones of the flow in the vicinity of the runner blades precludes erosion of their outlet edges.

The present invention makes it possible to prolong the life of turbine blades, to minimize the probability of emergencies, to reduce the maintenance costs of the turbine runner, as well as to enhance the efficiency, i.e. the economy ratings of a turbine within a broad range of operating duties.

BRIEF DESCRIPTION OF THE FIGURES

The characteristic features and other advantages of the invention will become apparent from the following description of the structural embodiments thereof and from the appended drawings, wherein.

BEST MODE FOR CARRYING OUT THE INVENTION

The disclosed exhaust pipe A (FIG. 1) of a turbine has a stationary housing 1. The walls of the housing 1 define a flow duct 2 adapted for the passage therethrough of the working fluid from the blades 3 of the runner 4 of the last stage of the turbine toward the outlet section 1*a* of the exhaust pipe A.

Figure 1:
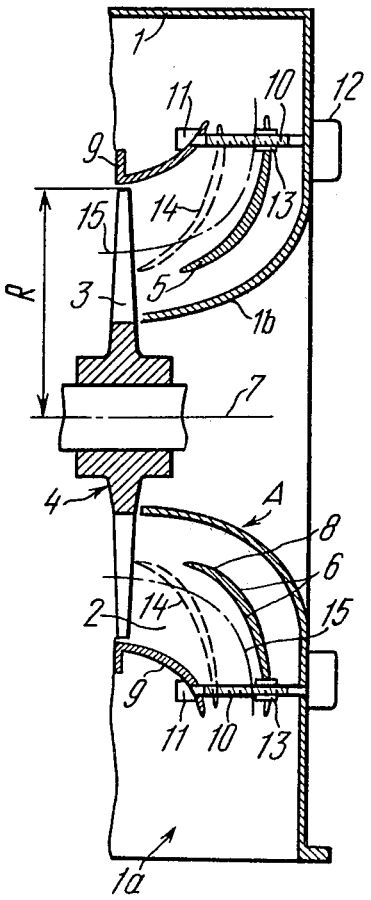
FIG. 1 is a schematic longitudinal sectional view of the exhaust pipe of a turbine in accordance with the invention, in an embodiment where the baffle is adjustable in the axial direction. A single baffle is shown for better clarity of the essence of the invention.
Figure 2:
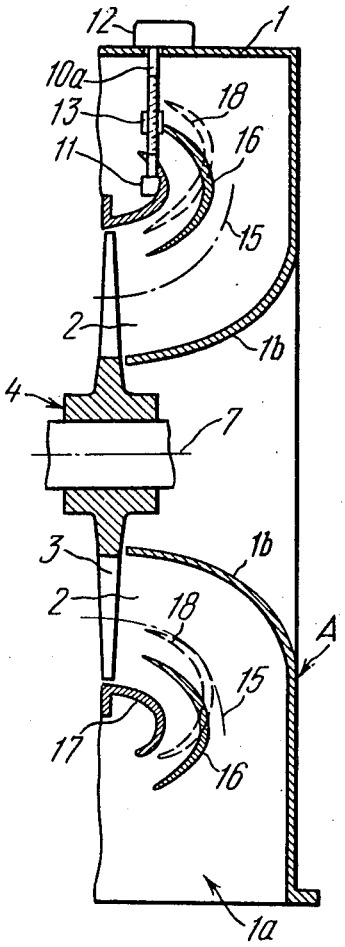
FIG. 2 is a schematic longitudinal sectional view of the exhaust pipe of a turbine in accordance with the invention, in an embodiment where the baffle is adjustable transversely of the axis of the turbine; with a single baffle shown for clarity's sake.
Figure 3:
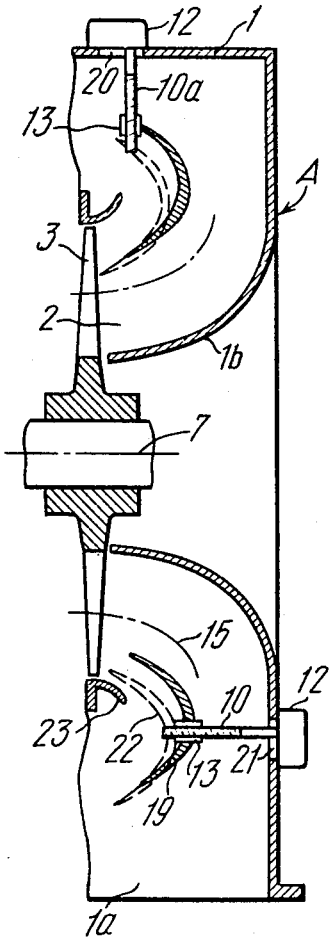
FIG. 3 is a schematic longitudinal sectional view of the exhaust pipe of a turbine in accordance with the invention, in an embodiment where the baffle is adjustable in the axial direction and in a direction transverse to the axis of the turbine; with a single baffle shown for clarity sake.

Baffles or deflectors are mounted within the flow duct 2. A single such baffle is shown in FIGS. 1, 2 and 3 for better clarity of the essence of the invention. The baffle 5 is intended to direct the working fluid from the blades 3 of the runner 4 of the last stage of the turbine toward the outlet section 1*a* of the exhaust pipe A.

The deflector 5 has side surfaces 6 which are essentially the surfaces of a body of revolution. These side surfaces 6 have a longitudinally axis 7 coinciding with the longitudinal axis of the turbine indicated with the same numeral 7.

Each side surface 6 further has an inlet portion 8 which has a radius shorter than the outer radius R of the blades 3 of the runner 4 of the last stage of the turbine.

Mounted adjacent to the free ends of the blades 3 of the runner 4 of the last stage of the turbine is a stationary annulus 9 secured to the housing 1 in any manner known per se. The annulus 9 is intended to direct the flow downstream of the blades 3 of the runner 4 of the last stage of the turbine.

Accommodated within the flow duct 2 of the exhaust pipe A are guides 10 supporting thereon the baffles 5 which are thus adjustment-wise movable axially of the housing 1 of the exhaust pipe A.

As it can be seen in FIG. 1, the guides 10 extend parallel with the longitudinal axis 7 of the turbine. The guides 10 of the presently described embodiment are screws having their first unthreaded ends journalled in bearings 11 which are known per se antifriction bearings mounted in the annulus 9. The opposite ends of the guides 10, which are likewise unthreaded, are operatively connected to respective drives 12 secured in any suitable known manner on the housing 1 of the exhaust pipe A, for which purpose corresponding holes are provided in the housing 1 of the exhaust pipe A for the passage of said unthreaded ends therethrough. The number of the guides 10 and drives or actuators 12 uniformly circumferentially spaced about the housing 1 is four in the presently described embodiment; however, in other embodiments this number may be different, but not short of three.

The drive 12 in this embodiment is an electric motor of any suitable known structure. Alternatively, it may be a hydraulic servomotor adapted to receive pressure pulses from the turbine control system which is not shown here.

The drive 12 is intended to rotate the guides 10 which are in threaded engagement with nuts 13. The nuts 13 are received and secured in any suitable manner known per se in respective openings provided in the baffle 5 for the passage of the guides 10 therethrough.

Thus, the guides 10 and respective nuts 13 jointly define kinematic lead screw-nut couples, so that the drives 12 can be operated to adjust axially the baffle 5, to alter the flow passage area and shape of the passage defined by the baffle 5 and the annulus 9. Broken lines 14 illustrate in FIG. 1 the extreme left-hand or upstream adjusted position of the baffle 5.

This construction effectively eliminates circulation zones in the flow duct 2 of the exhaust pipe A of the turbine, which otherwise might have been formed outwardly of the axis 15 of the flow duct 2 of the exhaust pipe A when the load of the turbine is short of the nominal one.

In another embodiment of the present invention, illustrated in FIG. 2, the baffle 16 is movable for adjustment transversely of the axis 7 of the turbine. The baffle 16, similarly to the baffle 5 described hereinabove in connection with FIG. 1, has lateral or side surfaces which are essentially the surfaces of a body of revolution about a longitudinal axis likewise coinciding with the axis 7 of the turbine.

In this embodiment there is mounted in the flow duct 2 a guide 10*a* extending transversely of the axis 7 of the turbine. The guide 10*a* has its one unthreaded end operatively connected with a drive 12 rigidly secured in any suitable manner known per se on the housing 1 of the exhaust pipe A. The drive 12 of this embodiment is an electric motor of any known structure able, to rotate the guide 10*a*.

Thus, the drive 12 is adapted to adjust the baffle 16 by means of the guide 10*a* transversely of the axis 7 of the turbine.

In this embodiment there is but one guide 10*a* and one drive 12. In other embodiments of the exhaust pipe A there may be a greater number of the guides 10*a* and respective drives 12.

The guide 10*a* has its opposite unthreaded end journalled in a bearing 11 which is an antifriction bearing of any suitable known structure secured in the annulus 17 in any suitable known manner.

The guide 10*a* is in kinematic engagement with a nut 13 mounted in the opening of the baffle 16 of a structure similar to that described in connection with FIG. 1, and secured in this opening in any suitable manner known per se, e.g. by welding.

Broken lines 18 illustrate in FIG. 2 the uppermost adjusted position of the baffle 16, in which the outermost portion of the exhaust pipe A has the reduced flow passage area of the passage defined by the baffle 16 and the annulus 17, i.e. the passage for the flow of the working fluid emerging from the blades 3 of the runner 4 of the last stage of the turbine in the area outwardly of the axis 15 of the flow duct 2 of the exhaust pipe A, in the direction toward the latter's outlet section 1*a*. In this case the baffle 16 becomes positioned eccentrically with respect of the axis 7 of the turbine, which has been found to enhance the axial symmetry of the flow of the working fluid at a turbine load short of the nominal one, which enhances the reliability and economy ratings of the turbine at such operating duties.

In still another embodiment of the present invention, illustrated in FIG. 3, one guide 10*a* is accommodated in the flow duct 2 of the exhaust pipe A to extend in a direction transverse of the axis 7 of the turbine, while other guides 10*a* are arranged axially of the turbine. In this embodiment there are one guide 10*a* and three guides 10 uniformly spaced circumferentially of the exhaust pipe A. In alternative embodiments there may be a different number of guides 10, and they may be circumferentially arranged in a different pattern.

The guides 10 and 10*a* have their respective one ends threadedly engaging nuts 13 mounted in the respective openings of the baffle 19 of a structure similar to that described in connection with FIG. 1, and secured therein in any suitable manner known per se.

The guides 10 and 10*a* have their respective opposite unthreaded ends operatively connected with drives 12 in a number equalling that of the guides. The drives 12 are mounted on the housing 1 in any suitable known manner and are adapted to rotate the respective guides 10 and 10*a*, for the latter to actuate the nuts 13 to adjust the baffle 19 relative to the housing 1 of the exhaust pipe A.

A slot 20 is provided in the housing 1 to permit an axial displacement of the guide 10*a* relative to the housing 1 of the exhaust pipe A when the guides 10 are operated to adjust the baffle 19 along the axis 7 of the turbine.

Other respective slots 21 in the housing 1 are provided to permit the displacement of the guides 10 transversely of the axis 7 of the turbine when the guides 10*a* are operated to adjust the baffle 19 in a direction transverse to the axis 7 of the turbine. With the guides 10*a* and 10 being conjointly rotated by the respective drives 12, the baffle 19 can be adjusted into the position illustrated in FIG. 3 with broken lines 22.

This construction of the exhaust pipe A broadens the capability of altering the cross-section of the passage defined by the baffle 19 and the annulus 23 of the flow emitted by the blades 3 of the runner 4 in the area defined by the axis 15 of the flow duct and the annulus 23, toward the outlet section 1*a* of the exhaust pipe A.

This construction enhances the axial symmetry of the flow, which, in its turn, enhances the reliability and economy ratings of the turbine.

In still another embodiment of the invention, illustrated in FIG. 4, the baffle 24 is adapted to the adjusted along guides 10 longitudinally of the axis 7 of the turbine by the respective drives 12, similarly to the manner described in connection with FIG. 1.

The guides 10 threadedly engage respective nuts 13 which are fast with the baffle 24, the guides 10 having their first unthreaded ends journalled in respective bearings 11 which are antifriction bearings of any suitable known structure secured to the annulus 25.

Figure 4:
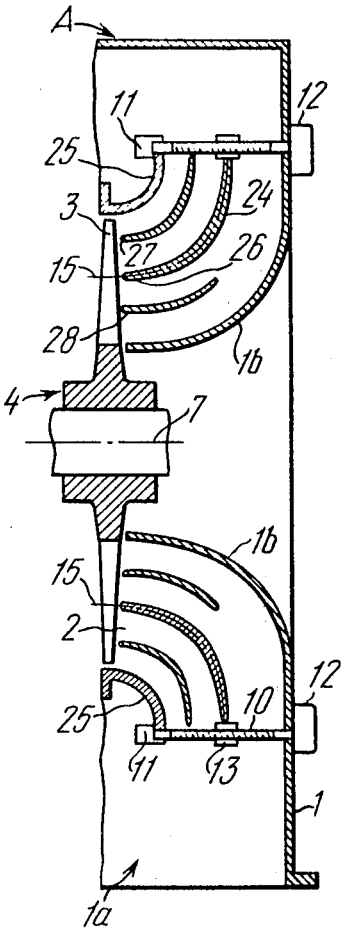
FIG. 4 is a schematic longitudinal sectional view of the exhaust pipe of a turbine in accordance with the invention, in an embodiment where the inlet portion of the baffle is substantially cylindrical, and the axial spacing of the edge of the inlet portion of the baffle from the outlet edges of the blades of the runner of the last stage of the turbine is at the minimum; with one baffle being axially adjustable and two other baffles being fixedly mounted.

The inlet portion 26 of the baffle 24 of which the position in FIG. 4 is aligned with the axis 15 of the flow duct 2 of the exhaust pipe A is substantially of a cylindrical shape, with the edge of this inlet portion 26 of the baffle 24 being spaced from the plane of the outlet or downstream edges of the blades 3 of the runner 4 of the last stage of the turbine by an axial extent of which the minimum value is somewhat in excess of the thermal expansion of the turbine.

With the load of the turbine relieved, the last-described construction ensures that the baffle 24 is passed around by the swirling flow with reduced energy losses, and curbs down the development of the circulation zone formed in the flow duct 2 within the exhaust pipe A, outwardly of the axis 15 of this flow duct 2.

Moreover, there are mounted in the flow duct 2 stationary baffles 27 and 28 which, same as the baffle 24, have side surfaces following the surfaces of respective bodies of revolution about a longitudinal axis coinciding with the axis 7 of the turbine.

The baffle 17 is received intermediate the annulus 25 and the axis 15 of the flow duct 2, while the baffle 28 is disposed, as it can be seen in FIG. 4, inwardly of the axis 15 of the flow duct 2. Both baffles 27 and 28, similarly to the baffle 24, have their respective inlet portions of substantially cylindrical shapes, with the axial spacing of their inlet edges from the plane of the outlet edges of the blades 3 of the runner 4 being somewhat in excess of the axial thermal expansion of the turbine.

This construction of the inlet portions of the stationary baffles 27 and 28, and the arrangement of the baffle 28 inwardly of the axis 15 of the flow duct 2 of the exhaust pipe A oppose the development of a circulation zone at relieved loads, which has been found to enhance the reliability and economy ratings of the turbine.

The exhaust pipe of a turbine of the embodiment illustrated in FIG. 1 operates as follows.

With the turbine operating at the nominal duty, i.e. with the working fluid flow entering axially the flow duct 2 of the exhaust pipe A, the baffle 2 is maintained in the positions shown in FIG. 1 with solid lines, with its side surface 6 essentially coinciding with the flow lines of the working fluid and thus being passed around with the minimum energy losses.

When operating with a reduced working fluid flow rate by volume, but with the turbine rotating at either the nominal or nearly-nominal angular speed, there is developed at the inlet of the flow duct 2 of the exhaust pipe A a significant circumferential velocity of the flow, with the flow lines in the blades 3 of the runner 4 of the last stage of the turbine becoming offset toward the free ends of the blades 3. Therefore, in the area of the flow duct 2 outwardly of the latter's axis 15 there is developed a circulation zone impairing the normal performance of the working blades 3 and of the exhaust pipe A of the turbine.

In this case all the drives 12 are energized simultaneously, either automatically or manually, to rotate the respective guides 10. With the guides 10 rotating, the nuts 13 are actuated axially of the turbine, moving the baffle 5 therealong.

Consequently, the annular passage defined by the baffle 5 and the annulus 9 alters its shape from the diffuser one to a confuser one, with its outlet section significantly reduced, while its inlet section remains essentially the same. Therefore, the greater share of the flow rate by volume of the working fluid now is taken up by the area of the flow duct 2, disposed, as shown in FIG. 1, inwardly of the axis 15 of the flow duct 2, which restores the breakoff-free flow in this area of the exhaust pipe A.

Thus, the proposed construction, while being sufficiently simple in manufacture and maintenance, provides for significant expansion of the range of the operating duties of the turbine with adequate economy ratings and enhanced reliability, as compared with hitherto known structures of exhaust pipes.

The exhaust pipe of the embodiment illustrated in FIG. 2 operates as follows.

Should there be detected or estimated a circumferential non-uniformity of the velocities and pressure values of the working fluid relative to the axis 7 of the turbine in the flow duct 2 of the exhaust pipe A, there is energized the drive 12 to rotate the guide **10*a* and thus to actuate the nut 13 with the baffle 16 in a direction transverse of the axis 7** of the turbine.

The direction of this displacement is selected so that the area of the outlet section of the passage defined by the baffle 16 and the annulus 17 should be constricted exactly where the pressure has become reduced. Upon adequate uniformity of the flow downstream of the blades 3 of the runner 4 having been thus attained, the drive 12 is deenergized, and the baffle 16 remains in the position which is the optimum one for the given operating duty.

Thus, this embodiment of the invention provides for maintaining an axial symmetry of the flow, whereby the economy ratings and reliability of the turbine are enhanced.

The exhaust pipe of the embodiment illustrated in FIG. 3 operates as follows.

Should there be either detected or estimated a circumferential non-uniformity of the velocities and pressure of the working fluid, and the development of a circulating motion in the flow duct 2 of the exhaust pipe A, the respective drives 12 of the guides 10 and **10*a* are simultaneously energized to actuate the nuts 13 with the baffle 19 both axially and transversely of the axis 7** of the turbine.

Thereby the circumferential non-uniformity of the velocities and pressure values is avoided within a wide range of loads, and there is precluded the development of the circulating motion in the flow duct 2 of the exhaust pipe A immediately downstream of the blades 3 of the runner 4 of the last stage, so that the reliability and economy ratings of the turbine are enhanced.

The exhaust pipe of the embodiment illustrated in FIG. 4 operates as follows.

With the operating duty of the turbine varying and a significant circumferential velocity of the working fluid flow developing at the inlet of the flow duct 2, the cylindrical inlet portions of the baffles 24, 27 and 28 of which the inlet edges, e.g. the inlet edge 26 of the baffle 28, are minimally spaced from the blades 3 of the runner 4, oppose a displacement of the flow lines of the working fluid toward the free ends of the blades 3, whereby the development of a circulation zone adjacent to the blades 3 is avoided.

The flow of the working fluid is acted upon particularly effectively by the inlet portion of the baffle 28 disposed in the flow duct 2 inwardly of the latter's axis 15.

This construction of the exhaust pipe enhances the operational reliability and economy ratings of the turbine where the latter's load varies.

Prototype versions of the herein disclosed exhaust pipe have been manufactured and subjected to thorough many-sided testing which has proved its high efficiency with the turbine running under various loads.

It will be understood that those skilled in the art will be able to introduce various modifications and changes into the exhaust pipe of the turbine which has been described hereinabove exclusively as a non-limiting example, without departing from the scope of the invention.

The present invention can be utilized to utmost effectiveness in axial-flow turbines with non-axisymmetric exhaust of the working fluid. The invention can be advantageously incorporated in steam and gas turbines operated to drive power generators, air blowers, ship propellers and the like, which are operated at varying flow rates of the working fluid and angular speeds.

What is claimed is:

1. An exhaust pipe for a turbine having a given axial thermal expansion and a last stage including a runner terminating outwardly in blades, comprising:

a housing having walls defining a flow duct;

a baffle in said duct;

said baffle having a side surface in the form of a surface of revolution and an inlet portion having a radius shorter than the outer radius of said blades of said runner;

said baffle having the longitudinal axis thereof substantially coincident with the axis of said turbine; and guide means mounted in said duct for adjustably supporting said baffle relative to said housing in a direction axial and transversal of said axis of said turbine.

2. The exhaust pipe of claim 1, said guide means including guides extending parallel with, and guides extending transversally of said axis of said turbine, and drive means operatively connected with said guides for adjusting said baffle.

3. The exhaust pipe of claim 1, wherein said inlet portion of said baffle has a substantially cylindrical shape.

4. The exhaust pipe of claim 2, wherein the edge of said inlet portion is spaced axially from the outlet edges of said runner by a distance greater than the extent of said axial thermal expansion.

5. An exhaust pipe for a turbine having a given axial thermal expansion and a last stage including a runner terminating outwardly in blades, comprising:

a housing having walls defining a flow duct;

a movable baffle in said duct;

said baffle having a side surface in the form of a surface of revolution and an inlet portion having a radius shorter than the outer radius of said blades of said runner;

said baffle having the longitudinal axis thereof substantially coincident with the axis of said turbine; and movable guide means mounted in said duct for adjustably supporting said baffle relative to said housing for moving said baffle in a direction relative to said axis of said turbine.

6. The exhaust pipe of claim 5, wherein said side surface is a surface of revolution about an axis coinciding with said axis of said turbine.

7. The exhaust pipe of claim 5, further including a stationary annulus secured to said housing and mounted adjacent the free ends of said blades.

8. The exhaust pipe of claim 7, wherein:

said baffle is mounted on a shaft passing through said housing;

said shaft having an end journalled in said annulus;

said shaft having its other end connected to drive means for adjusting said baffle.

9. In an exhaust pipe for a turbine having a given axis and a housing with walls defining a flow duct accommodating therein a baffle;

said baffle having a side surface in the shape of a surface of a body of revolution and a longitudinal axis coinciding with the axis of said turbine, said baffle having an inlet portion of a radius shorter than the outer radius of the blades of the runner of the last stage of the turbine, the improvement wherein said flow duct of said exhaust pipe accommodates therein guides adjustably supporting thereon said baffle relative to said housing of said exhaust pipe, said guides being movable in at least one direction axially and transversely of said axis of said turbine.

10. The exhaust pipe of claim 9, wherein said guides are so arranged that some of them are parallel with said axis of said turbine, while the others extend transversely thereto.

11. The exhaust pipe of claim 10, wherein said guides are screws operatively connected each with a respective drive;

said baffle having openings therethrough for the passage of said screws;

said openings receiving therein nuts secured to said baffle and defining kinematic couples with the respective screws;

said walls of said housing having therein slots for the displacement therein of said screws, respectively, axially of said turbine and transversely of said axis thereof.

12. The exhaust pipe of claim 5;

said movable guide means includes guides extending parallel with said axis of said turbine; and drive means operatively connected with said guides for adjusting said baffle.

13. The exhaust pipe of claim 5;

said movable guide means includes guides extending transversely of said axis of said turbine;

drive means operatively connected with said guides for adjusting said baffle.

14. The exhaust pipe of claim 5, wherein said inlet portion of said baffle has a substantially cylindrical shape.

15. The exhaust pipe of claim 5, wherein the edge of said inlet portion is spaced axially from the outlet edges of said runner by a distance greater than the extent of said axial thermal expansion.

16. The exhaust pipe of claim 2, wherein said inlet portion of said baffle has a substantially cylindrical shape.

17. The exhaust pipe of claim 16, wherein the edge of said inlet portion is spaced axially from the outlet edges of said runner by a distance greater than the extent of said axial thermal expansion.

18. The exhaust pipe of claim 1, wherein said guide means includes guides so arranged that some of them are parallel with said axis of said turbine, while the others extend transversely thereto.

19. The exhaust pipe of claim 10, wherein said guides are screws operatively connected each with a respective drive;

said baffle having openings therethrough for the passage of said screws;

said openings receiving therein nuts secured to said baffle and defining kinematic couples with the respective screws;

said walls of said housing having therein slots for the displacement therein of said screws, respectively, axially of said turbine and transversely of said axis thereof.

* * * * *